US009212026B2

(12) United States Patent
Holawe

(10) Patent No.: US 9,212,026 B2
(45) Date of Patent: Dec. 15, 2015

(54) LIFTING PLATFORM AND METHOD FOR SETTING UP A LIFTING PLATFORM

(75) Inventor: Walter Holawe, Neumarkt (AT)

(73) Assignee: Doka Industrie GmbH, Amstetten (AT)

( * ) Notice: Subject to any disclaimer, the term of this patent is extended or adjusted under 35 U.S.C. 154(b) by 982 days.

(21) Appl. No.: 12/306,451

(22) PCT Filed: Jun. 19, 2007

(86) PCT No.: PCT/EP2007/056064

§ 371 (c)(1),
(2), (4) Date: Dec. 23, 2008

(87) PCT Pub. No.: WO2008/000654

PCT Pub. Date: Jan. 3, 2008

(65) Prior Publication Data

US 2009/0272604 A1 Nov. 5, 2009

(30) Foreign Application Priority Data

Jun. 28, 2006 (DE) ..... 10 2006 029 653

(51) Int. Cl.
*B66B 9/187* (2006.01)
*B66B 9/16* (2006.01)

(52) U.S. Cl.
CPC ..... *B66B 9/16* (2013.01)

(58) Field of Classification Search
CPC ..... E04G 1/20; E04G 1/22; B66F 11/04; B66B 9/187; B66B 9/16
USPC ..... 187/240, 242, 270, 239, 241; 182/69.6, 182/144, 148, 186.5, 82
See application file for complete search history.

(56) References Cited

U.S. PATENT DOCUMENTS 3,207,263 A * 9/1965 Cull ..... 187/241
3,318,414 A * 5/1967 Meek ..... 182/115
3,763,964 A * 10/1973 Davis ..... 187/239
4,496,277 A * 1/1985 Jungman ..... 414/589

(Continued)

FOREIGN PATENT DOCUMENTS

CA 2143813 A1 9/1995
EP 0034819 A2 9/1981

(Continued)

OTHER PUBLICATIONS

Picture of a device described in the first paragraph of the application, publication date unknown, 1 page.

*Primary Examiner* — William A Rivera
*Assistant Examiner* — Michael Riegelman
(74) *Attorney, Agent, or Firm* — Fitch, Even, Tabin & Flannery, LLP

(57) ABSTRACT

A lifting platform (10) in the construction field comprises a base (12), which can be set up on a ground (14) and converted into a console, which can be suspended on a structure (18) with distance to the ground (14), and a platform (20), which can be lifted in relation to the base (12) both in the state in which it is set up on the ground (14) and in the state suspended on the structure (18). A method for setting up a lifting platform (10) in the construction field, comprising a base (12) and a platform (20), includes the following steps: Setting up the base (12) on a ground (14) such that the platform (20) can be lifted in relation to the base (12), lifting the base (12), converting the base (12) into a console that can be suspended on a structure (18), and suspending the console on a structure (18) in a state that again allows the platform (20) to be lifted.

15 Claims, 4 Drawing Sheets

(56) References Cited

U.S. PATENT DOCUMENTS

| | | | | | |
|---|---|---|---|---|---|
| 4,962,828 | A | * | 10/1990 | Duncan | 182/82 |
| 5,156,235 | A | * | 10/1992 | Preston | 182/186.9 |
| 5,630,482 | A | * | 5/1997 | Schw orer | 182/82 |
| 6,170,608 | B1 | * | 1/2001 | Gresser et al. | 182/141 |
| 6,883,643 | B2 | * | 4/2005 | Robillard | 182/146 |

FOREIGN PATENT DOCUMENTS

| | | | |
|---|---|---|---|
| JP | 5301690 | A | 11/1993 |
| JP | 6115858 | A | 4/1994 |
| WO | 98/53161 | A1 | 5/1998 |
| WO | 2007/036300 | A1 | 4/2007 |
| WO | 2007/141264 | A1 | 12/2007 |

* cited by examiner

LIFTING PLATFORM AND METHOD FOR SETTING UP A LIFTING PLATFORM

TECHNICAL FIELD

The invention relates to a lifting platform and a method for setting up a lifting platform.

In the field of construction, so-called formwork tables are known for the shuttering of ceilings. These substantially consist of one or more shuttering panels on their upper surface which form part of the form lining for a ceiling to be erected. The shuttering panels are commonly supported by formwork girders that may be arranged as longitudinal and transverse girders in a lattice-like manner, for example. The formwork girders are supported towards the underside, i.e. towards an already existing ceiling or the ground, by props. Once a ceiling has been cast in concrete using formwork tables of this kind, it is desirable for reasons of efficient construction progress to bring these tables as quickly and easily as possible "onto" the newly erected ceiling in order to cast the ceiling above.

Prior Art

On the one hand, so-called extendable platforms are known for hoisting formwork tables to a higher level. These protrude outwardly from the structure, substantially from an existing ceiling, such that a formwork table may be disposed thereon which can then be lifted to a higher level by a crane. In order not to have to depend on a crane, scissor tables are furthermore known which can be disposed on extendable platforms or consoles suspended on the structure. The respective formwork table is disposed on the lowered scissor table, the scissor table is lifted, and the formwork table can then be set up at the higher level.

In addition, hoists or lifting boom platforms are known that are supported on the ground and allow lifting from one floor level to a higher one. Consoles also exist which are designed to be comparatively heavy and which are fastened to building parts situated at a higher level. A lifting unit is provided on these console solutions. The process for changing the position of such a console or moving it to a higher level is comparatively complicated since the lifting unit must be lifted off and set down on the ground, for example. Then, the console is fastened and repositioned, following which the lifting unit can be replaced.

Known from U.S. Pat. No. 3,207,263 is a climbing system having a comparatively small lifting ramp for lifting formwork. The climbing system must be suspended on a building.

The described arrangements can be designated as lifting platforms insofar as they comprise a liftable platform.

SUMMARY OF THE INVENTION

The invention is based on the object of providing a lifting platform and a method for setting up the same, which have been improved to the effect that the lifting platform is suitable for bringing formwork tables to a higher level with little effort in different situations throughout construction.

This object is solved, on the one hand, by the subject matter of claim 1.

In accordance therewith, the lifting platform according to the invention comprises a base that can, on the one hand, be set up on a ground. On the other hand, the base can be converted into a console that is suspendable on a structure at a distance to the ground. The lifting platform further comprises a platform that can be lifted in relation to the base both in the state in which it is set up on the ground and in the state suspended on the structure. In the respective situation, commonly at the start of a construction project, the lifting platform according to the invention can be set up with its base on the ground, and in this state formwork tables, which were used for casting the ceiling of a ground-level floor in concrete, can be lifted onto the ceiling of this first floor in order to cast the ceiling above. The platform can be provided on the base by means of, for example, one or more lifting booms so that it can be lifted to further levels, i.e. to a second, third or higher ceiling, as counted from the ground, in the state in which the base is set up on the ground. In this state, the lifting platform according to the invention is thus supported on the ground.

The novel lifting platform offers the advantage, however, that its base can be converted into a console that can be suspended on a structure. As a result, the console is, in other words, situated at a distance from the ground. On the one hand, this offers the advantage that particularly with high buildings the lifting booms or other components forming a hoist to higher levels do not have to be extended to such an extent that is required with systems, the base of which remains on the ground. Rather, the console can be situated at a specific level, at a distance from the ground, and can make it possible for formwork tables to be lifted from this level to higher levels by means of comparatively short lifting booms or similar components. Furthermore, due to the fact that the base of the lifting platform according to the invention can be converted into a console that is suspendable on a structure, the area of the ground on which the base was first situated can be "vacated", and other work in this area is no longer obstructed.

In addition, the formwork tables can be lifted to a higher level not using a crane. The base of the lifting platform according to the invention, which has been converted into a console, can, on the one hand, be lifted by means of a crane. On the other hand, it is conceivable, as will be detailed in the following, for the base to be provided with one or more climbing profiles by means of which the console can "climb up" the structure, as is generally known for self-climbing formworks. As regards the console described above, which has a liftable platform and is provided with a climbing mechanism, it should be mentioned that this is also advantageous irrespective of the measure according to the invention that the console is the result of converting a base that can be set up on the ground. Accordingly, a console with a liftable platform, which is capable, in one of the embodiments described above or hereinbelow, of climbing on a structure and has one or more of the features given above or hereinbelow, can be considered to be subject matter of the application.

Preferred further developments of the lifting platform according to the invention are described in the further claims.

It has proven to be advantageous for the base to have at least one vertical and/or horizontal profile. The vertical profile can advantageously be used to suspend the console, into which the base can be converted, on a structure. When there is a horizontal profile, the base can be set up on the ground as with rails. It is, however, also or additionally conceivable for spindle feet to be provided on a horizontal profile to suitably set up the base.

In order to enable the console of the lifting platform according to the invention to "climb" as indicated above, it is currently preferred for at least one vertical profile to be designed as a climbing profile. This has suitable contours, for example protruding climbing lobes, teeth, recesses, openings or the like, to enable engagement with suitable climbing drives. As regards the configuration of the console of the lifting platform according to the invention as a "climbing console", reference is made to patent application 10 2006 026

201.8, entitled "Self-climbing system", which was filed by the applicant on Jun. 6, 2006 and the disclosure of which is made subject matter of the application in respect of all of the details of the climbing system. The scaffolding unit mentioned therein is comparable in this respect to the console of the lifting platform according to the invention. A similar arrangement can be seen in DE 10 2005 045527 of the applicant, wherein the vertical profiles mentioned therein correspond to the vertical profiles of the console of the lifting platform according to the invention. Furthermore, said climbing profile may be attachable, in the same manner as described in the last-mentioned application, to cantilever beams of a building. As an alternative or in addition to this, the climbing profile can be provided with one or more guide shoes by means of which the climbing profile can be suspended and/or guided on wall shoes, as is disclosed in the first application mentioned above. As regards the possibilities for lifting the protection and access device described in said application, the disclosure thereof is likewise made subject matter of the present application.

To convert the base, which can be set up on the ground, into a console that is suspendable on a structure, it is currently preferred for at least one profile extension to be provided that may also be designed as a climbing profile. Such a profile extension is preferably adjustable, which is advantageous in particular in connection with climbing profiles.

It has proven to be advantageous for the profile extension to be insertable into a profile and/or hingeable to a profile. Specifically the hinged attachment can already be provided for on the base in the state in which it is set up on the ground. In other words, the base is set up on the ground in a state in which at least one profile extension is already hinged thereto. It is likewise conceivable for one or more profile extensions to be hinged to the base and/or inserted into profiles of the base after the base has been set up on the ground for some time. In any case, after lifting of the base, conversion into a console takes place in that, inter alia, the hinged profile extension is pivoted, for example brought into a vertical orientation, and is connected, in a manner resistant to bending, to an already existing vertical profile of the base.

As an alternative or in addition to this, it is advantageous for at least one insertable profile extension to be displaceable in a profile of the base. For example, it can be desirable for the console to have a profile disposed at a level below the liftable platform. As long as the base is situated on the ground, it is impossible for a profile extension to be provided in a region below the platform, i.e. below the base. According to the described preferred embodiment, the profile extension can, however, first be inserted or provided on the base in the inserted state, and can be shifted during conversion of the base into a console—after this has been lifted—so as to then extend into a level below the platform.

It is currently preferred for the design of the console that at least one profile of the base have a suspending device with which the console, into which the base was converted, can be suspended on the structure and/or on a girder attached thereto.

It has proven to be useful, at least for a hingeably attachable profile extension, to provide this with a supporting device that is preferably adjustable. For example, a support can be provided at an angle to a vertical profile in a region below the liftable platform. Such a profile extension, which serves as a support, can first be hingeably provided on the base and can be folded, during lifting of the base and/or conversion of the same into a console, into the correct orientation and connected with at least one profile.

As mentioned, it is basically conceivable to suitably provide the platform so that it can be lifted only to the next highest level. It is, however, currently preferred for the platform to be designed so as to be able to bridge several levels, i.e. several heights between floors. For this, it is currently preferred for the lifting platform to be provided with at least one lifting boom that may advantageously be extendable.

For a stable connection between the base or the console of the lifting platform according to the invention and the lifting boom described, it has proven to be useful for the lifting boom to be connected with at least one profile of the base/console. This is advantageous in that additional anchorages in the upper region of the lifting booms can be dispensed with.

In order to make the lifting platform according to the invention suitable for as many applications as possible, it is currently preferred for the platform to be designed so as to be extendable in width. This is preferably achieved by individual modules that can be joined on the construction site. As an alternative, it can be useful to design the platform so as to be capable of telescoping.

On the other hand, the invention provides a method for setting up a lifting platform which may make it possible to bring formwork tables to higher levels efficiently and with very few individual components.

According to the method of the invention, a lifting platform comprising a base and a platform is assembled in that first of all the base is set up on the ground such that the platform can be lifted in relation to the base. It is thus made possible in this state to bring formwork tables from the ground level to the level of higher floors in order to cast there ceilings in concrete. Later, however, the base is lifted and converted into a console that is suspendable on a structure. This console can thereafter be suspended on the structure in a state which again allows the platform to be lifted. This also makes it possible to lift formwork tables from higher levels to levels above. In addition, the ground is not permanently occupied by the set-up basis, as is the case with known hoisting or lifting boom systems. Finally, those components which permit lifting to higher levels, such as for example lifting booms, can be kept comparatively short throughout the entire construction since the console can be suspended on the structure at a certain level, as mentioned, and the possibility of lifting formwork tables from there to higher levels can be ensured.

The preferred further developments of the method according to the invention substantially correspond to the preferred further developments of the lifting platform thus created.

BRIEF DESCRIPTION OF THE DRAWINGS

In the following, the invention will be detailed with reference to embodiments illustrated by way of example in the drawings in which.

DETAILED DESCRIPTION OF PREFERRED EMBODIMENTS OF THE INVENTION

Figure 1:
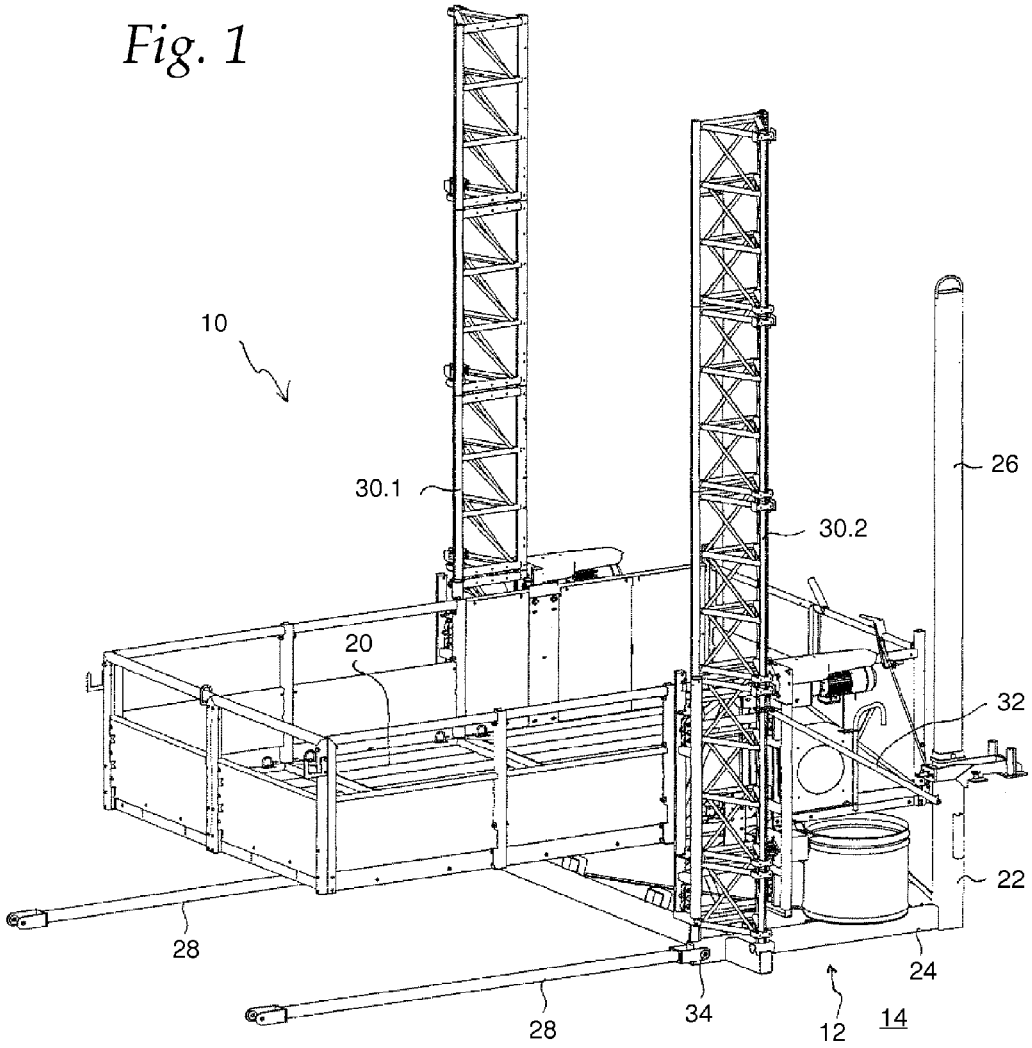
FIG. 1 shows a perspective view of a base of the lifting platform according to the invention which is set up on the ground and has profile extensions provided thereon.

As can be recognized in FIG. 1, the base 12 of the lifting platform 10 according to the invention comprises, in the shown embodiment, at least two vertical profiles 22 and at least two horizontal profiles 24, of which only the right-hand profile can be recognized in each case in FIG. 1, whereas the left-hand or rear profile is concealed by the platform 20. It will be appreciated that further profiles may be present beneath and behind the platform and that the profiles are connected to each other such that a rigid base 12 results, which—as shown in FIG. 1—can be set up on a ground 14. In the shown embodiment, the base is furthermore provided, for example on its external surfaces, with lifting booms 30.1, 30.2, which enable lifting of the platform 20 to a higher level by means of suitable drives. The lifting booms 30 can be extendable. They may in particular be extendable such that the platform 20 can be lifted to the level of a ceiling 18 above (see FIG. 2) or to an even higher level. For stability, the respective lifting boom 30 is firmly connected to a profile 22 of the base by means of a respective strut 32.

The lifting platform according to the invention is shown in a situation in FIG. 1 in which it has already been prepared for conversion into a console. This is reflected by the fact that a profile extension 26 is in each case inserted from above into the two vertical profiles 22 and is displaceable in the profile 22 as soon as the lifting platform is lifted. A second profile extension 28 is in each case hinged to the horizontal profiles 24 by means of a joint 34. The base can be set up on the ground using the profile extensions 26, 28 already provided thereon. As an alternative, it can be set up on the ground without said profile extensions, and these can be attached subsequently. During conversion into a console, the lifting platform is lifted as a whole, i.e. including the base 12, such that the profile extensions 26 are displaced in the profiles 22, yet remain substantially stationary while the lifting platform is lifted. This lifting furthermore makes it possible for the profile extensions 28 to be pivoted into the region below the base 12 and to then be fastened to the profile extensions 26 now situated beneath the base 12 for support. As viewed laterally, this substantially gives rise to the shape of a right-angled triangle consisting of the horizontal profile 24, the profile extension 26 and the downwardly folded profile extension 28. The right angle is formed between the horizontal profiles 24 and the profile extension 26. Following this conversion, said profiles and profile extensions form a console that can be suspended on a structure.

Figure 2:
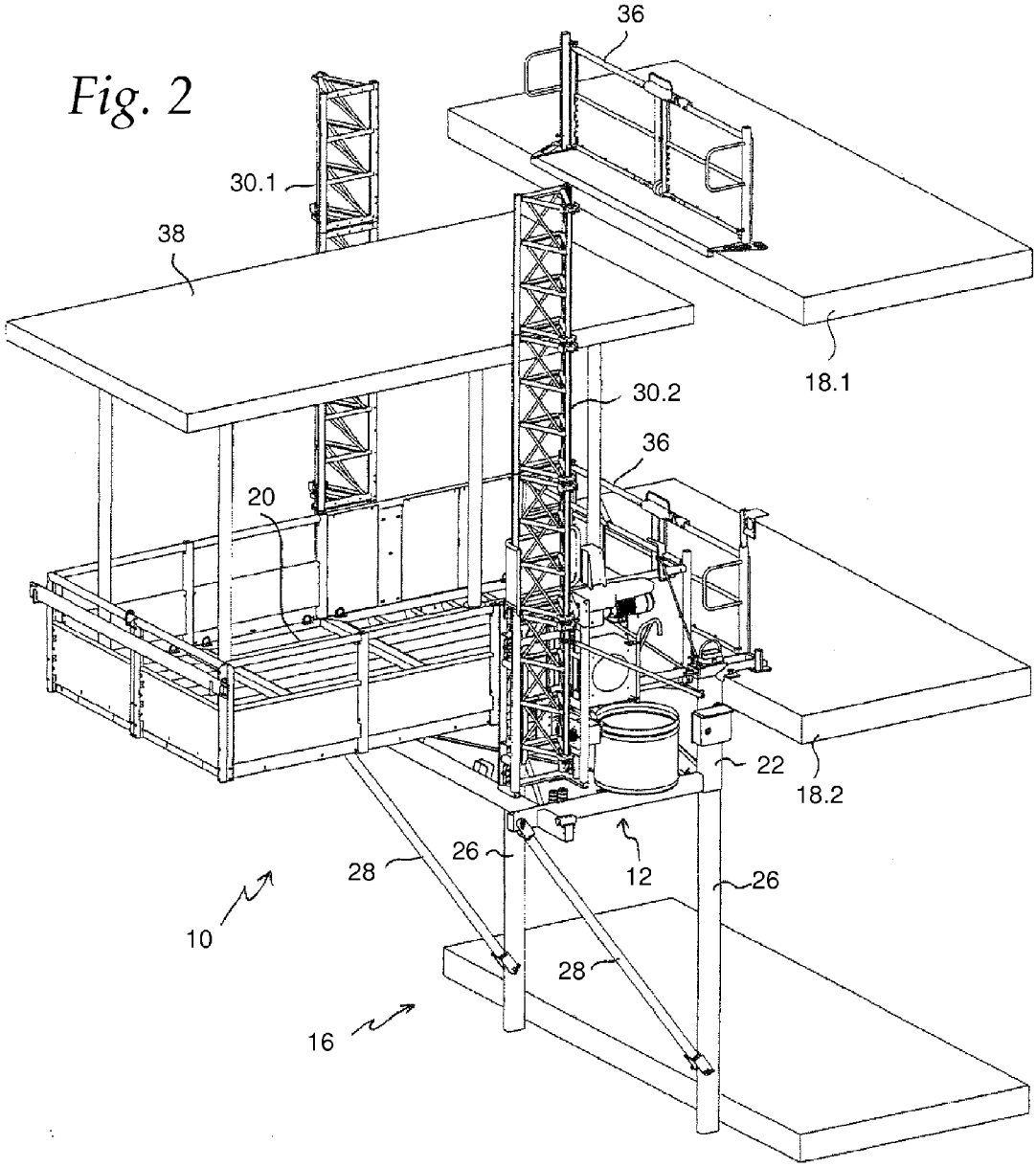
FIG. 2 shows a perspective view of the console of the lifting platform according to the invention which is suspended on a structure and has two lifting booms.

This state is shown in FIG. 2. As compared to the situation shown in FIG. 1, the base 12 was lifted so as to be situated in the region of a lower ceiling 18.2 of two ceilings 18.1, 18.2, as shown by way of example in FIG. 2. In connection with the lifting operation, the profile extensions 26 were pushed downwardly through the profiles 22 such that the base 12 can be supported on the downwardly pushed profile extensions 26 by means of the further profile extensions 28 which were folded downwardly in the meantime. The base 12 was thus converted in the described manner into a console that can be suspended on a structure, i.e. on the lower ceiling 18.2 in the case shown, at a distance to the ground. In the shown example embodiment, a securing gate 36 is provided on the ceilings 18.1, 18.2 towards the lifting platform 10. When the securing gate 36 is open, formwork tables, as are shown by way of example in FIG. 2 in the form of the formwork table 38, can be placed on the liftable platform 20 of the lifting platform 10. Following lifting of the platform 20 by means of the lifting booms 30 and suitable drives, the formwork table 38 can be unloaded to the higher ceiling 18.1 and can be used there for shuttering the next ceiling. In order to bring the formwork tables to even higher levels, the lifting booms 30 can be further extended. In this connection, they can be fastened to one or more ceilings 18 separately of the base 12. Furthermore, the lifting platform 10 including the console 16, which serves for suspension on the building, can be brought to higher levels in that the console is detached from the ceiling 18.2 and is brought to a higher level and suspended there by means of a crane, for example.

Figure 3:
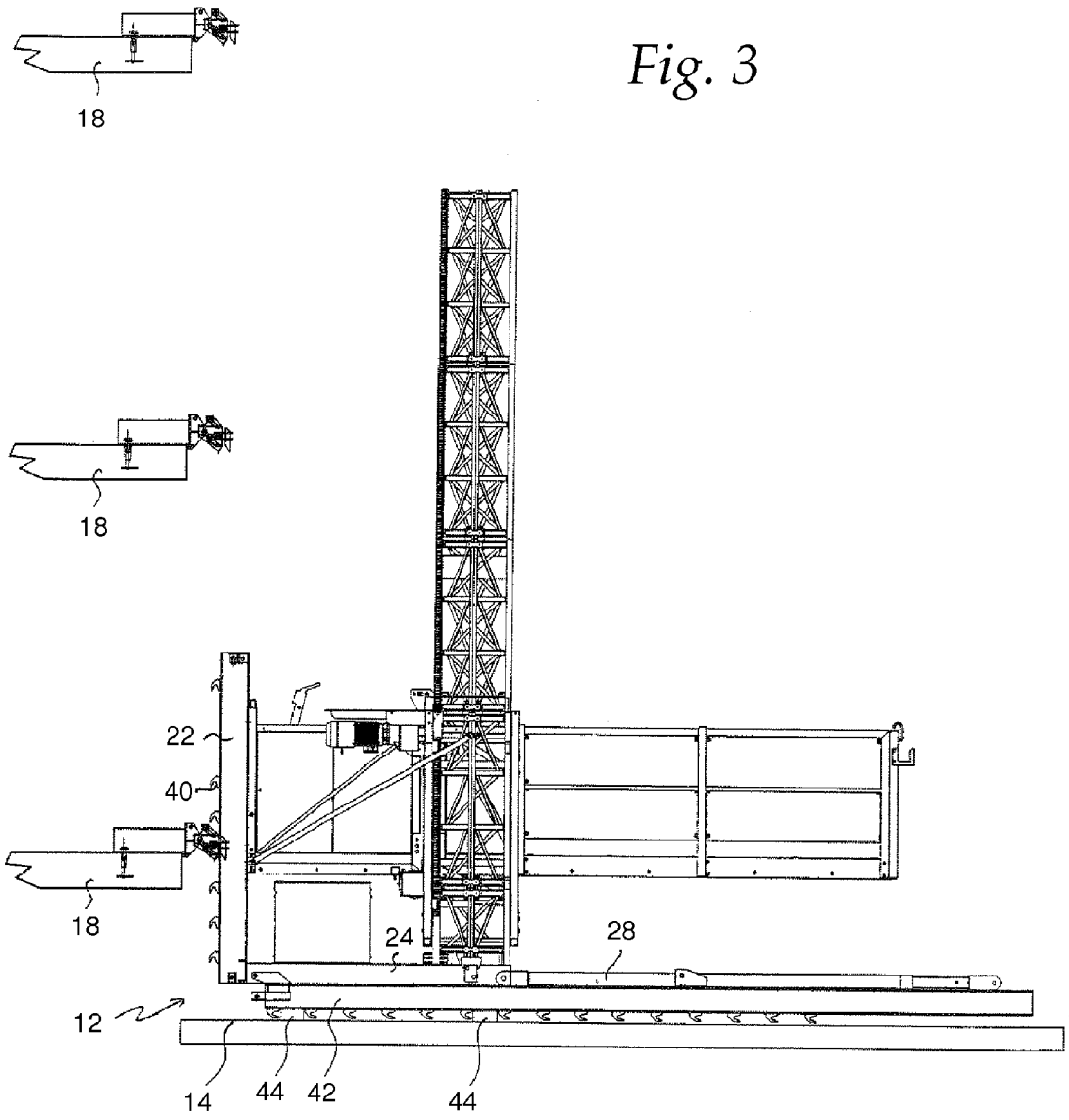
FIG. 3 shows a lateral view of a base of the lifting platform according to the invention which is set up on the ground in the form of an embodiment as a base for a climbing console.
Figure 4:
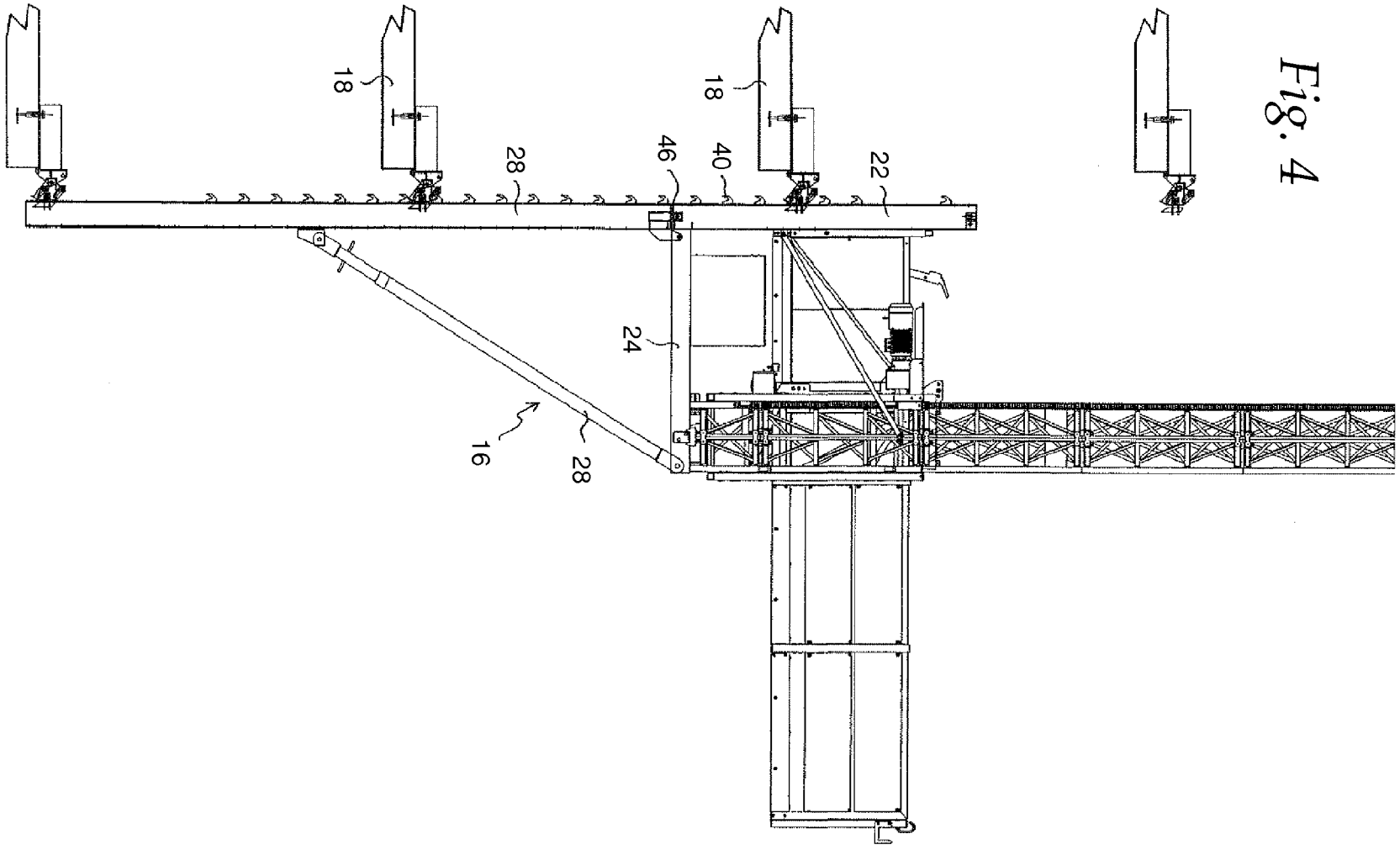
FIG. 4 shows a console of the lifting platform according to the invention which is suspended on a structure in the form of an embodiment as a climbing console.

As an alternative, the console can be lifted by means of a climbing system, as shown in FIGS. 3 and 4. The embodiment of FIG. 3 largely corresponds to the previously described embodiment, with the exception that the vertical profiles 22, of which only one can be seen in the lateral view of FIG. 3, are designed as climbing profiles which are provided, in the shown example, with protruding climbing lobes 40. It will be appreciated that protruding teeth, recesses, a hole profile or any other suitable contour can be used instead of the climbing lobes 40. In connection with the details of a climbing system, reference is in addition made to the aforementioned applications of the applicant.

Another difference between the embodiment of FIGS. 3 and 4 and those of FIGS. 1 and 2 is that the vertical profile 22 is extendable by means of a pivotable profile extension 42, which is likewise designed as a climbing profile. Further profile extensions 28 are provided in a region of the horizontal profile 24 that is spaced from the structure (see ceilings 18), such that the base 12 shown in FIG. 3 can also be converted into a console 16, which is shown in FIG. 4. It should also be mentioned with regard to FIG. 3 that the state of the base 12 as set down on the ground 14 is shown here. For this purpose, a plurality of feet 44 can be provided on the base 12 and in particular on the horizontal profiles 24, which create a spacing to the ground 14 beneath the base 12, in which the profile extensions 42 can be received.

In this embodiment, conversion into the console 16 as shown in FIG. 4 takes place in that the base 12 is lifted such that the profile extensions 28 can be folded into the region beneath the vertical profiles 22 and are then bolted at the joint 46 so as to be connected to each other in a manner resistant to bending. As with the embodiment of FIGS. 1 and 2, the horizontal profiles 24 are supported by the profile extensions 28 which are provided at an angle in the final state and are preferably adjustable in this case. The climbing profiles 22, 28 can be hung in guide or wall shoes mounted on the ceilings 18 by means of the climbing lobes 40. It is possible to lift the entire console by means of suitable drives (not shown), as is described in detail in the aforementioned applications. As an alternative, this embodiment also permits lifting by means of a crane. Even if a crane is used for lifting, it is in particular also possible for the console to be guided in that the climbing profiles 22, 28, which can be configured for example as I-sections, engage with the wall or guide shoes.

The invention claimed is:

1. A lifting platform comprising:

a base configured to be set up on a ground surface and converted into a console that is suspendable from a structure at a distance from the ground surface;

at least one lifting boom positioned above the base when the base is set up on the ground surface and the console when in the state suspended on the structure;

a platform which is positioned vertically above and liftable in relation to the base both in the state in which the base is set up on the ground surface and in the state suspended on the structure via the at least one lifting boom;

a hinge; and at least one profile extension that extends below the lifting platform and is connected to a profile via the hinge to permit pivoting the at least one profile extension from a first configuration below the base when the base is set up on the ground surface to a vertical configuration below the console when in the state suspended on the structure.

2. The lifting platform according to claim 1, wherein the base has at least one of a vertical profile, a horizontal profile, and a combination thereof.

3. The lifting platform according to claim 2, wherein the base includes at least one vertical profile designed as a climbing profile having contours configured for engagement with a climbing mechanism.

4. The lifting platform according to claim 2, wherein the lifting boom is connected with at least one horizontal profile.

5. The lifting platform according to claim 1, wherein the base comprises at least one suspending device with which the console is configured to be suspended on at least one of the group consisting of the structure and a girder attached thereto.

6. The lifting platform according to claim 1, wherein the at least one profile extension comprises at least one adjustable supporting device.

7. The lifting platform according to claim 1, wherein the platform is extendable in width.

8. The lifting platform of claim 1 further comprising an inclined extension that is configured to extend from the base to the profile extension when in the state suspended on the structure.

9. The lifting platform of claim 1 wherein the at least one profile extension includes climbing contours thereon such that when in the vertical configuration, the climbing contours assist vertically raising the lifting platform along the structure.

10. A method for setting up a lifting platform having a base and a platform, the method including the following steps:

setting up the base on a ground surface such that the platform is positioned vertically above and can be lifted in relation to the base via at least one lifting boom positioned vertically above the base, lifting the base, converting the base into a console that is suspendable on a structure by pivoting at least one adjustable profile extension hingeably coupled to a profile of the base from a first configuration below the base to a vertical configuration extending below the lifting platform, and suspending the console on the structure in a state which again allows the platform to be lifted vertically above the console via the at least one lifting boom.

11. The method according to claim 10, wherein at least one profile is suspended on at least one of the group consisting of the structure and a girder attached thereto.

12. The method according to claim 10, further comprising the step of extending the at least one lifting boom.

13. The method according to claim 10, further comprising the step of extending the width of the platform.

14. A lifting platform comprising:

a base configured to be set up on a ground surface and converted into a console that is suspendable from a structure at a distance from the ground surface;

at least one lifting boom positioned vertically above the base when the base is set up on the ground surface;

a platform which is positioned vertically above and liftable in relation to the base both in the state in which the platform is set up on the ground surface and in the state suspended on the structure via the at least one lifting boom; and at least one vertical profile extension which is configured for insertion into a vertical profile and being displaceable therein, wherein, in the state in which the platform is set up on the ground surface, a portion of the at least one vertical profile extension extends above the platform and when transformed to the state suspended on the structure, the portion of the vertical profile extension is moved through the vertical profile such that the portion of the vertical profile extension extends below the platform.

15. A method for setting up a lifting platform having a base and a platform, the method including the following steps:

setting up the base on a ground surface such that the platform is positioned vertically above and can be lifted in relation to the base via at least one lifting boom positioned vertically above the base, lifting the base, converting the base into a console that is suspendable on a structure by inserting at least a portion of an adjustable profile extension above the base into at least one profile of the base and moving the portion of the adjustable profile extension through the at least one profile such that the portion of the adjustable profile extension extends below the platform, and suspending the console on the structure in a state which again allows the platform to be lifted vertically above the console via the at least one lifting boom.

* * * * *